US007610977B2

(12) United States Patent
Kluver et al.

(10) Patent No.: US 7,610,977 B2
(45) Date of Patent: Nov. 3, 2009

(54) LIFT TRUCK HAVING HYDRAULICALLY SEPARATE MAIN FRAME AND POWER UNIT ASSEMBLY

(75) Inventors: Leroy M. Kluver, Celina, OH (US); Jay L. Kuck, St. Marys, OH (US)

(73) Assignee: Crown Equipment Corporation, New Bremen, OH (US)

( * ) Notice: Subject to any disclaimer, the term of this patent is extended or adjusted under 35 U.S.C. 154(b) by 919 days.

(21) Appl. No.: 10/947,908

(22) Filed: Sep. 23, 2004

(65) Prior Publication Data

US 2006/0151249 A1 Jul. 13, 2006

(51) Int. Cl.
*B66F 9/06* (2006.01)

(52) U.S. Cl. ..... 180/65.51; 180/65.1; 187/222; 187/231

(58) Field of Classification Search ..... 180/65.2, 180/305, 306, 307, 308; 187/222, 226, 231, 187/234, 237; 414/663, 664, 668, 349
See application file for complete search history.

(56) References Cited

U.S. PATENT DOCUMENTS

| | | | | |
|---|---|---|---|---|
| 2,693,290 | A | 11/1954 | Elliott et al. | |
| 3,050,153 | A | 8/1962 | Molis | |
| 3,394,778 | A * | 7/1968 | Brinton | 187/227 |
| 3,512,453 | A | 5/1970 | Balzer | |
| 3,515,233 | A | 6/1970 | Stammen | |
| 3,756,350 | A | 9/1973 | Gandolfo et al. | |
| 3,948,356 | A * | 4/1976 | Keene | 187/237 |
| 4,018,307 | A * | 4/1977 | Ehrhardt et al. | 187/234 |
| 4,177,001 | A * | 12/1979 | Blackwood | 414/628 |
| 4,216,847 | A | 8/1980 | Jalbert et al. | |
| 4,286,692 | A | 9/1981 | Bauer et al. | |
| 4,287,966 | A | 9/1981 | Frees | |
| 4,458,785 | A * | 7/1984 | Bushnell, Jr. | 187/231 |
| 4,552,250 | A | 11/1985 | Luebrecht | |
| 4,592,449 | A | 6/1986 | Sakata et al. | |
| 4,600,084 | A | 7/1986 | Ray | |
| 4,683,987 | A | 8/1987 | Sakata et al. | |

(Continued)

FOREIGN PATENT DOCUMENTS

| | | |
|---|---|---|
| GB | 1 462 688 | 1/1977 |

OTHER PUBLICATIONS

Philippe Becamel and M. Masset; International Preliminary Report on Patentability; International Application No. PCT/US2005/033899; Mar. 27, 2007; International Bureau of WIPO; Geneva Switzerland.

*Primary Examiner*—Christopher P Ellis
*Assistant Examiner*—Vaughn T Coolman
(74) *Attorney, Agent, or Firm*—Stevens & Showalter LLP

(57) ABSTRACT

A lift truck is provided comprising: a power unit assembly comprising a power unit base, a wheel coupled to the base, and a system for driving the wheel; and a main frame assembly detachably connected to the power unit assembly. The main frame assembly comprises a main frame base, a mast assembly coupled to the main frame base, a carriage assembly coupled to the mast assembly, and hydraulic drive apparatus coupled to the mast assembly. Preferably, substantially the entirety of the hydraulic drive apparatus is provided on the main frame assembly such that the main frame assembly is detachable from the power unit assembly without requiring disconnecting hydraulic connections to the power unit assembly.

21 Claims, 7 Drawing Sheets

U.S. PATENT DOCUMENTS 4,875,555 A * 10/1989 Johansson et al. ..... 187/226
4,889,038 A * 12/1989 Bentivoglio ..... 92/110
4,940,381 A 7/1990 Rysewyk
4,943,756 A 7/1990 Conley, III et al.
5,011,363 A 4/1991 Conley, III et al.
5,022,496 A 6/1991 Klopfleisch et al.
5,044,472 A 9/1991 Dammeyer et al.
5,184,699 A * 2/1993 Aoki et al. ..... 187/224
5,265,021 A * 11/1993 Avitan ..... 701/41
5,462,136 A 10/1995 Schoenmaker et al.
5,520,258 A 5/1996 Kemshall
5,573,366 A * 11/1996 Meijer ..... 414/664
5,647,457 A 7/1997 Wegdam et al.
5,657,834 A 8/1997 Plaugher et al.
5,890,563 A * 4/1999 Avitan et al. ..... 187/228
5,992,572 A * 11/1999 Gilliland et al. ..... 187/231
5,994,650 A 11/1999 Eriksson et al.
6,182,778 B1 2/2001 Henshaw et al.
6,182,797 B1 2/2001 Tebbe et al.
6,226,582 B1 5/2001 Adsett et al.
6,499,567 B2 12/2002 Foschini et al.
6,616,395 B2 9/2003 Fransson
6,648,581 B2 11/2003 Gibson
7,207,405 B2 * 4/2007 Reid et al. ..... 180/65.3
2001/0052433 A1 * 12/2001 Harris et al. ..... 180/68.5
2002/0050416 A1 5/2002 Brown
2003/0070850 A1 * 4/2003 Reid et al. ..... 180/68.5
2003/0075376 A1 4/2003 Steele
2003/0230456 A1 12/2003 Gyllenhammar et al.
2004/0241521 A1 * 12/2004 Finkelshtain et al. ..... 429/34
2005/0095500 A1 * 5/2005 Corless et al. ..... 429/100

* cited by examiner

LIFT TRUCK HAVING HYDRAULICALLY SEPARATE MAIN FRAME AND POWER UNIT ASSEMBLY

TECHNICAL FIELD

The present invention relates to a fork lift truck comprising a power unit assembly detachably connected to a main frame assembly, wherein substantially all hydraulic components are mounted on the main frame assembly.

BACKGROUND OF THE INVENTION

Fork lift trucks, such as turret stockpicker trucks, comprising a power unit assembly detachably connected to a main frame assembly are known in the prior art. In such a truck, the power unit assembly comprises a power unit base, at least one wheel coupled to the base and being driven by one or more traction motors, a battery for providing power to the traction motor(s), and a traction motor control module(s) for controlling the operation of the traction motor(s). A first hydraulic motor/pump assembly and at least one manifold valve block are also mounted on the power unit base. The main frame assembly comprises a main frame base, a mast assembly comprising a fixed first mast and a second mast movable relative to the first mast, a piston/cylinder unit for effecting movement of the second mast relative to the first mast, a second hydraulic motor/pump assembly for providing pressurized fluid to the piston/cylinder unit for effecting movement of the second mast, and a carriage assembly coupled to said second mast for movement with the second mast. Further provided on the main frame base is a hydraulic fluid reservoir and at least one manifold valve block.

Because the first hydraulic motor/pump assembly and at least one manifold valve block are mounted on the power unit base and the fluid reservoir is mounted on the main frame assembly, hydraulic tubes/lines extend between the power unit and main frame assemblies. Hence, in order to separate those assemblies, such as for shipping the truck, one or more of the hydraulic tubes/lines extending between the power unit assembly and the main frame assembly must be disconnected. Such a disassembly operation is disadvantageous due to its complexity. Also, disconnecting one or more hydraulic lines/tubes increases the risk that those lines/tubes may become contaminated with moisture, dirt, air, etc. A further disadvantage to having the first hydraulic motor/pump assembly mounted on the power unit is that it is located in close proximity to many of the electronic and electrical components. As a result, there is an increased risk that those electronic and electrical components may be contaminated with hydraulic fluid or dirt accumulated on the first hydraulic motor/pump assembly mounted to the power unit base.

SUMMARY OF THE INVENTION

In accordance with the present invention, a fork lift truck, such as a turret stockpicker truck, is provided comprising a power unit assembly detachably connected to a main frame assembly, wherein substantially all hydraulic components are mounted on the main frame assembly. Consequently, when the truck is separated, such as for shipping, no hydraulic tubes/lines extending between the power unit and main frame assemblies need be disconnected. Hence, the disassembly operation is simplified. Further, risk of moisture, dirt, air, etc. contaminating open hydraulic tubes/lines is reduced. Also, the length of hydraulic tubes/lines required on the truck is reduced since tubes/lines extending between the power unit and main frame assemblies are not required. This reduces costs as well as pressure drops within the hydraulic system.

In accordance with a first aspect of the present invention, a lift truck is provided comprising: a power unit assembly comprising a power unit base, at least one wheel coupled to the base, and a system for driving the wheel; and a main frame assembly detachably connected to the power unit assembly. The main frame assembly comprises a main frame base, a mast assembly coupled to the main frame base, a carriage assembly coupled to the mast assembly, and hydraulic drive apparatus, preferably coupled to the mast and carriage assemblies. Preferably, substantially the entirety of the hydraulic drive apparatus is provided on the main frame assembly such that the main frame assembly is detachable from the power unit assembly without requiring disconnecting hydraulic connections to the power unit assembly. A control structure, such as a control module, for controlling the operation of the hydraulic drive apparatus is provided and, preferably, is located on the power unit assembly.

The hydraulic drive apparatus may comprises a hydraulic fluid reservoir, a hydraulic motor/pump assembly, and a manifold system. Preferably, the reservoir is spaced from the motor/pump assembly and the manifold system.

The main frame base may comprise front and rear portions. The mast assembly, the hydraulic fluid reservoir and the hydraulic motor/pump assembly are preferably located at the rear portion of the main frame base, with the reservoir being positioned on a first side of the mast assembly and the motor/pump assembly being positioned on a second side of the mast assembly.

The power unit system for driving the at least one wheel may comprise at least one traction motor, a battery for providing power to the motor, and a control module for controlling the operation of the traction motor.

As noted above, the main frame base may comprise front and rear portions. Similarly, the power unit base may comprise front and rear portions. The rear portion of the main frame base may be positioned adjacent to the front portion of the power unit base, and the traction motor and the traction motor control module may be located in the rear portion of the power unit base.

The power unit assembly may further comprise a steer motor for effecting steering movement of the wheel and a steer motor control module for controlling the operation of the steer motor. The steer motor and the steer motor control module are preferably located in the rear portion of the power unit base.

The mast assembly may comprise a fixed first mast, a second mast movable relative to the first mast and a mast piston/cylinder unit for effecting movement of the second mast relative to the first mast. The carriage assembly may comprise a platform assembly coupled to the second mast so as to move with the second mast. The platform assembly may be movably coupled to the second mast so as to move relative to the second mast as well as with the second mast.

The carriage assembly may further comprise a load handler assembly movably coupled to the platform assembly and a fork carriage assembly movably coupled to the load handler assembly.

In accordance with a second aspect of the present invention, a lift truck is provided comprising: a power unit assembly comprising a power unit base having front and rear portions, at least one wheel, at least one traction motor for driving the at least one wheel, a battery for providing power to the at least one traction motor, and at least one traction motor control module for controlling the operation of the at least one traction motor. The at least one wheel, traction motor and traction motor control module are preferably mounted in the rear portion of the power unit base. The lift truck further comprises a main frame assembly comprising a main frame base having front and rear portions, a mast assembly, a carriage assembly coupled to the mast assembly, and hydraulic drive apparatus coupled to the mast assembly. The front portion of the power unit base may be coupled to the rear portion of the main frame base. The power unit assembly may further comprise a hydraulic drive apparatus control module, which, preferably, is mounted in the rear portion of the power unit base for controlling the operation of the hydraulic drive apparatus.

The hydraulic drive apparatus may comprise a hydraulic fluid reservoir, a hydraulic motor/pump assembly and a manifold system. The reservoir is preferably spaced from the motor/pump assembly and the manifold system.

The mast assembly, the hydraulic fluid reservoir and the hydraulic motor/pump assembly are preferably located at the rear portion of the main frame base, with the reservoir being positioned on a first side of the mast assembly and the motor/pump assembly being positioned on a second side of the mast assembly.

The power unit assembly may further comprise at least one steer motor for effecting steering movement of the at least one wheel and a steer motor control module for controlling the operation of the steer motor. The steer motor and the steer motor control module are located in the rear of the power unit base.

In accordance with a third aspect of the present invention, a fork lift truck is provided comprising a power unit assembly detachably connected to a main frame assembly, wherein substantially all truck hydraulic components are mounted on the main frame assembly while substantially all truck electronic control modules are mounted on the power unit assembly.

DETAILED DESCRIPTION OF THE INVENTION

Figure 1:
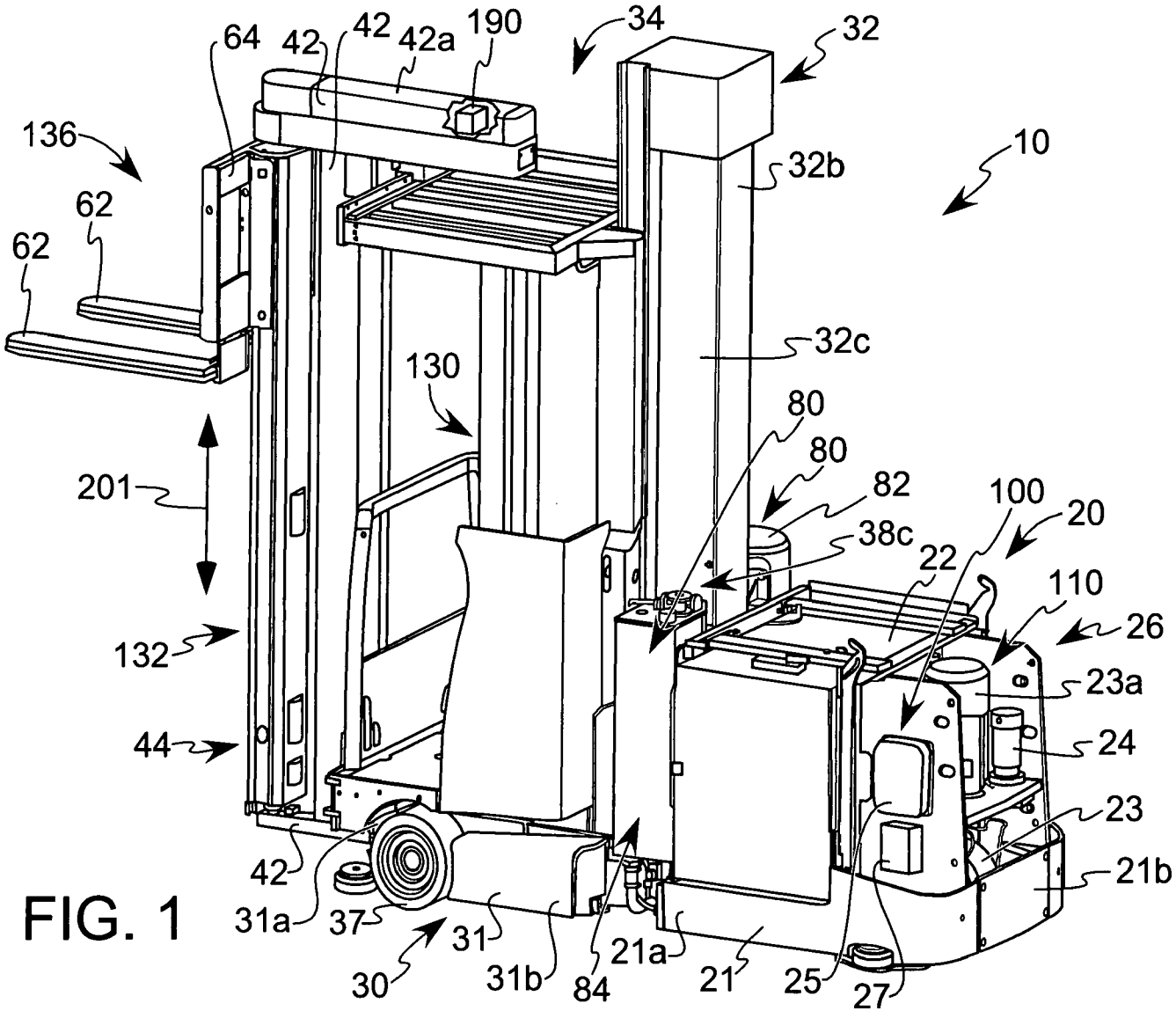
FIGS. 1 and 2 are perspective views, from opposite sides, of a materials handling vehicle constructed in accordance with the present invention with outer covers on the power unit and main frame assemblies removed.
Figure 2:
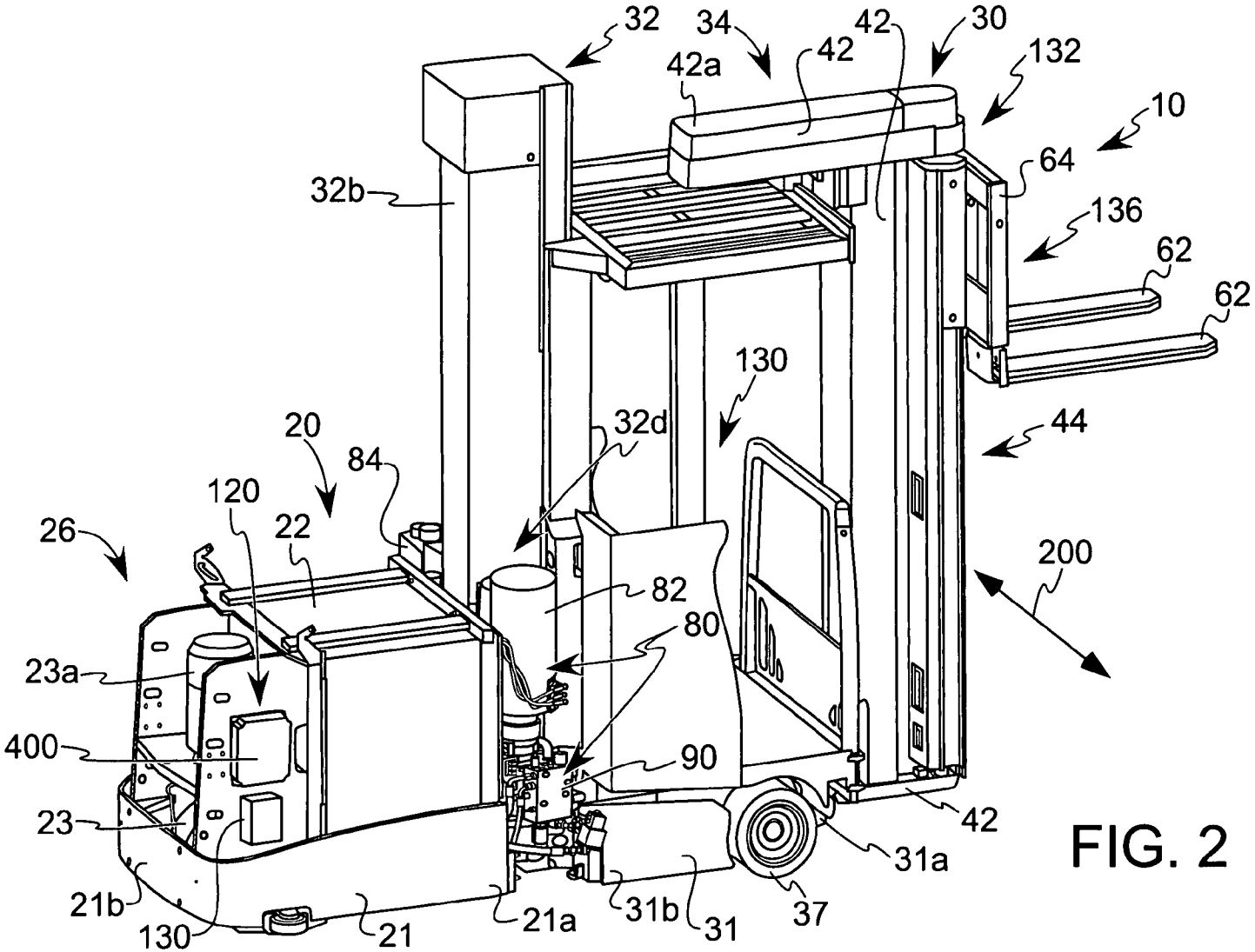
Figure 3:
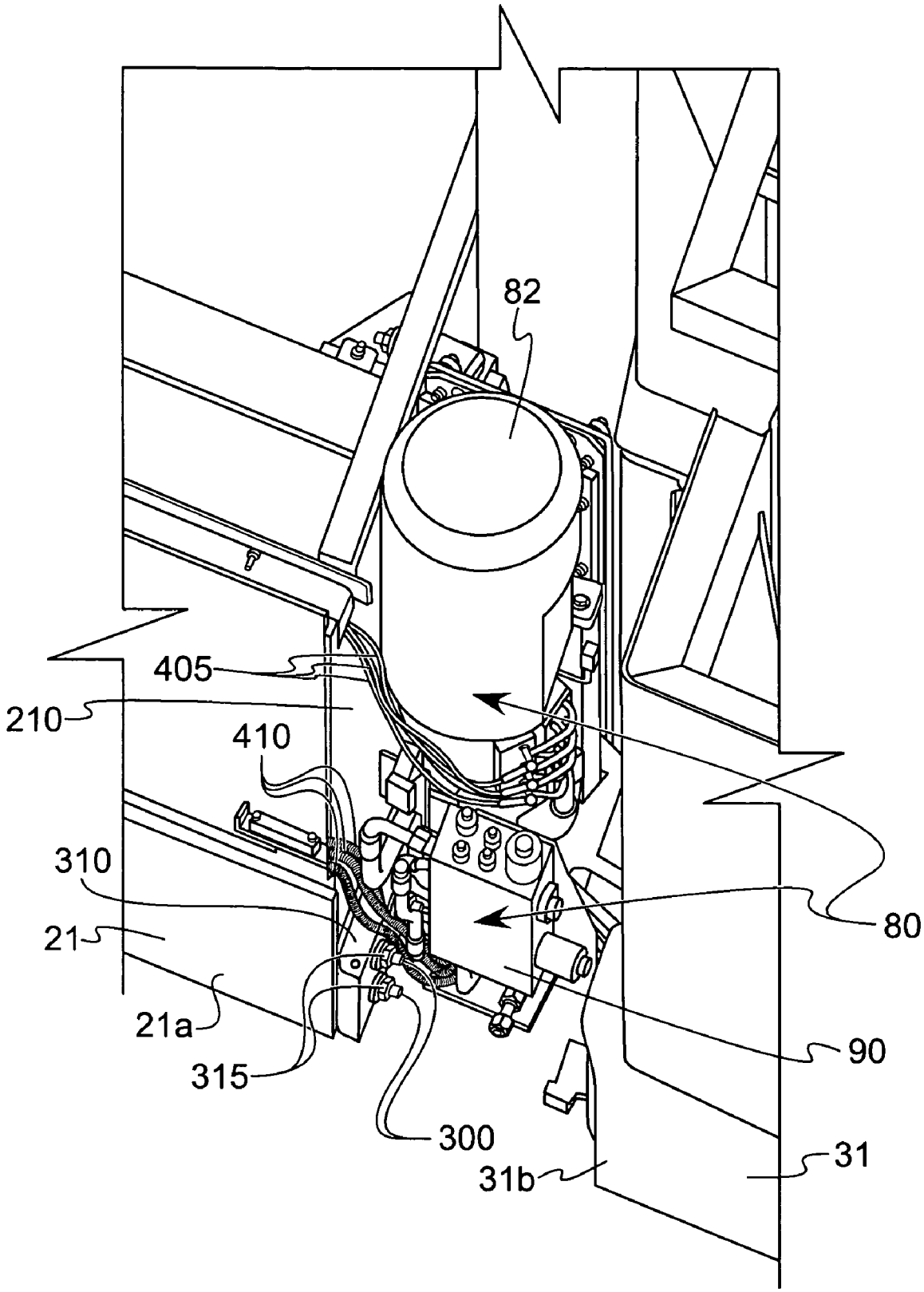
FIG. 3 is a perspective view of the hydraulic motor/pump assembly and first manifold of the vehicle illustrated in FIG. 1.
Figure 4:
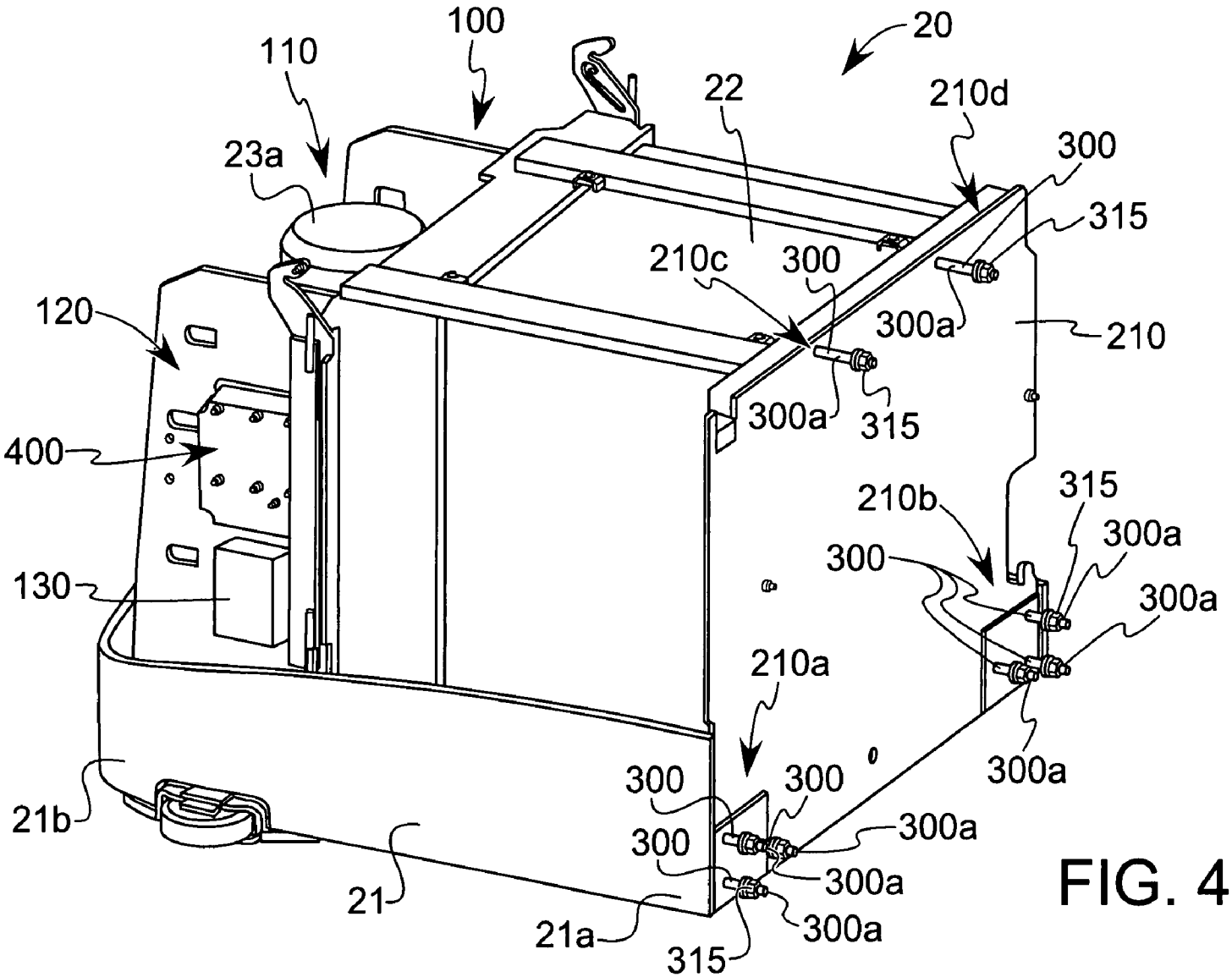
FIG. 4 is a perspective view of the power unit assembly with outer covers removed and shown disconnected from the main frame assembly.
Figure 5:
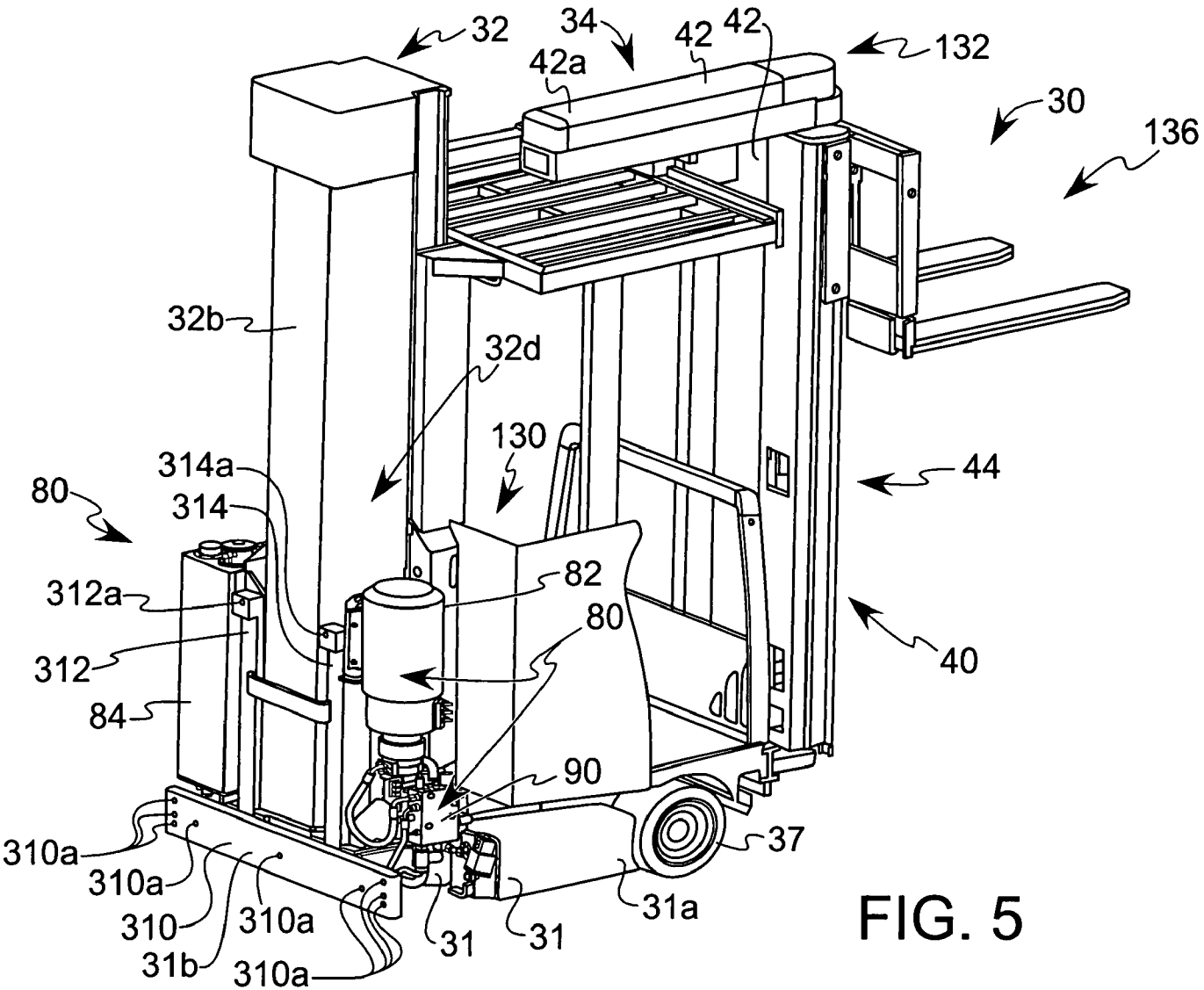
FIG. 5 is a perspective view of the main frame assembly with outer covers removed and shown disconnected from the power unit assembly.
Figure 6:
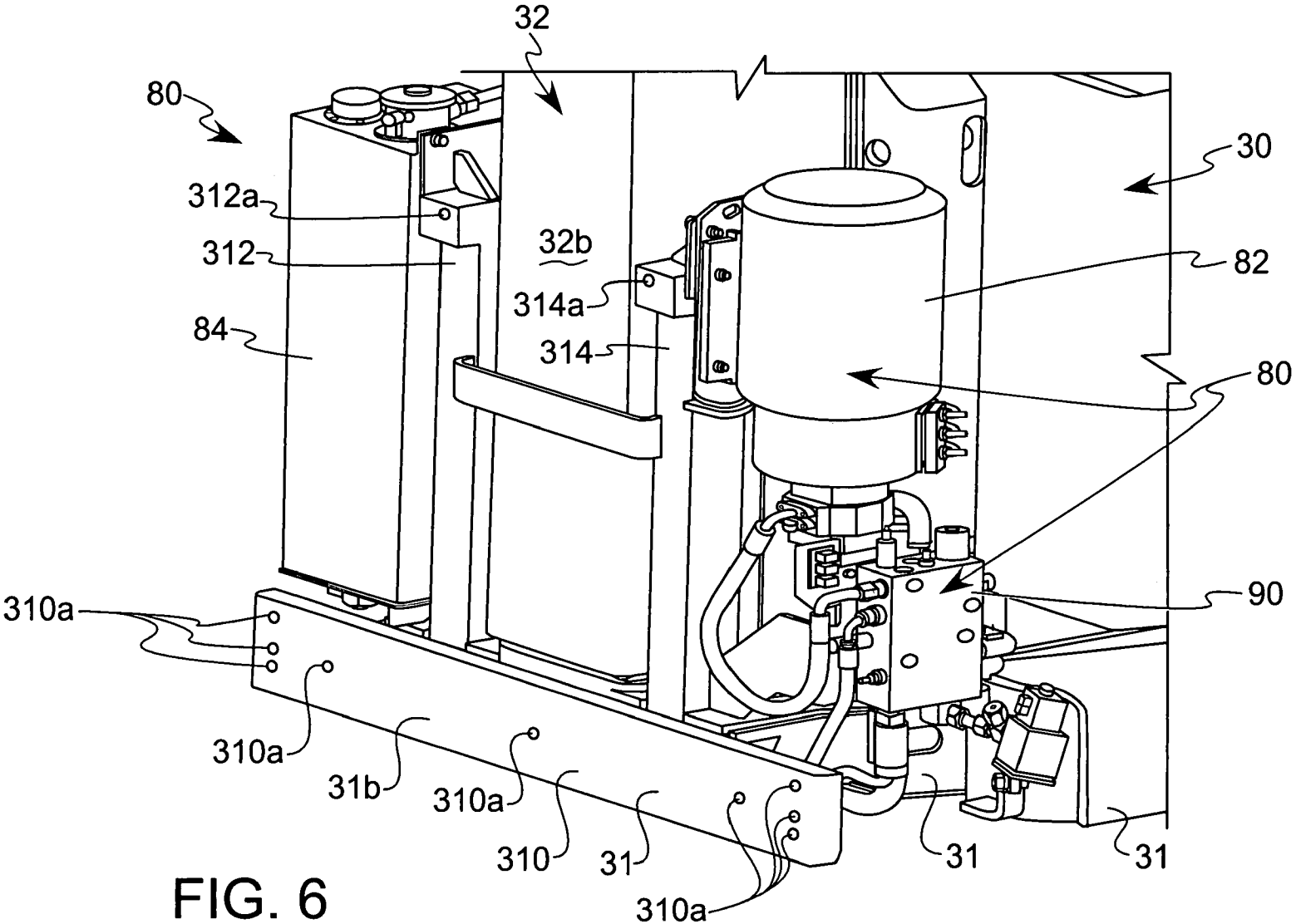
FIG. 6 is a perspective view of a portion of the main frame assembly and illustrating a rear portion of the main frame base.

Referring now to the drawings, and particularly to FIGS. 1 and 2, which illustrate a materials handling truck or vehicle 10 constructed in accordance with the present invention. In the illustrated embodiment, the vehicle 10 comprises a turret stockpicker. The vehicle 10 includes a power unit assembly 20 and a main frame assembly 30, which assemblies 20 and 30 are releasably coupled together, as will be discussed more explicitly below. The power unit assembly 20 includes a power unit base 21 having front and rear portions 21*a* and 21*b*, respectively, a power source, such as a battery unit 22, positioned on the base 21, a steered wheel 23 rotatably coupled to the base rear portion 21*b*, a traction motor 23*a* for driving the wheel 23 and a traction motor control module 25 for controlling the operation of the traction motor 23*a*, i.e., its speed and direction, in response to operator generated commands, see FIGS. 1, 2 and 4. The main frame assembly 30 comprises a main frame base 31 having front and rear portions 31*a* and 31*b*, respectively, a mast assembly 32 coupled to the base 31, a carriage assembly 34 coupled to the mast assembly 32, a hydraulic drive apparatus 80 coupled to the base 31, the mast assembly 32 and the carriage assembly 34, and a pair of load wheels 37 coupled to the main frame base 31. The carriage assembly 34 comprises, in the illustrated embodiment, a platform assembly 130 adapted to carry an operator and coupled to the mast assembly 32, a load handling assembly 132 coupled to the platform assembly 130, and a fork carriage assembly 136 coupled to the load handling assembly 132.

Figure 1B:
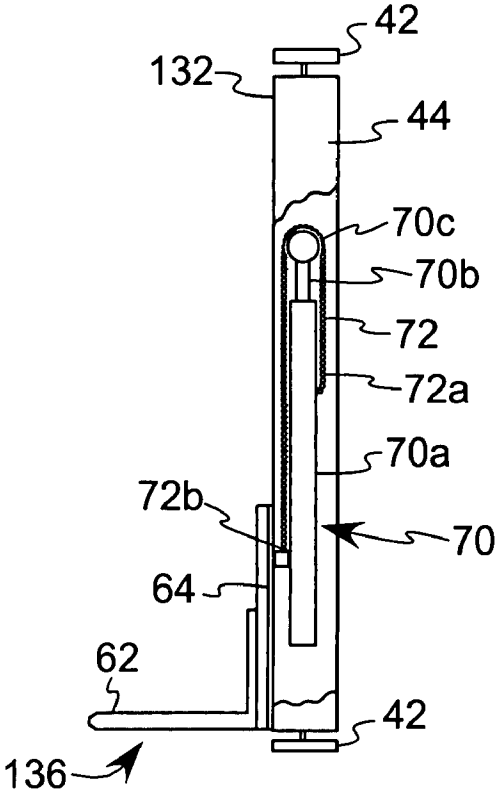
FIG. 1B is a schematic view illustrating a piston/cylinder unit of the auxiliary mast of the vehicle illustrated in FIG. 1.
Figure 1A:
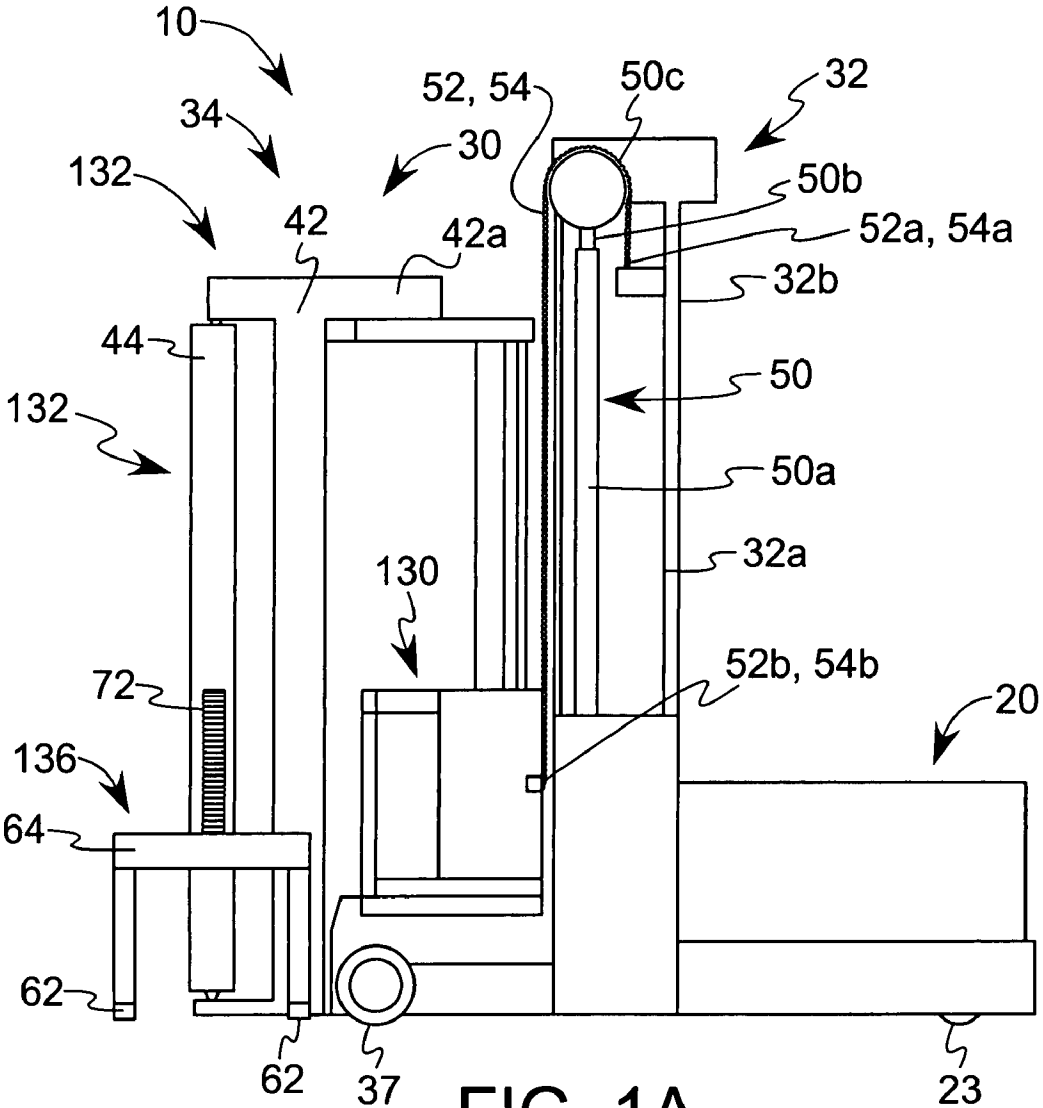
FIG. 1A is a schematic view illustrating the first and second masts, and a piston/cylinder unit of the main mast assembly of the vehicle illustrated in FIG. 1.

The mast assembly 32 comprises a first mast 32*a* fixedly coupled to the main frame base 31, a second mast 32*b* movable coupled to the first mast 32*a*, and a main mast piston/cylinder unit 50, see FIG. 1A. In the illustrated embodiment, the platform assembly 130 is movably coupled to the second mast 32*b* so as to move relative to the second mast 32*b* and with the second mast 32*b*. The load handling assembly 132 is coupled to the platform assembly 130 and, hence, moves vertically with the platform assembly 130.

The mast piston/cylinder unit 50 is provided in the first mast 32*a* for effecting movement of the second mast 32*b* relative to the first mast 32*a* and the base 31, see FIG. 1A. The cylinder 50*a* forming part of the piston/cylinder unit 50 is fixedly coupled to the base 31. The piston 50*b* forming part of the unit 50 is fixedly coupled to the second mast 32*b* such that movement of the piston 50*b* effects movement of the second mast 32*b* relative to the first mast 32*a*. The piston 50*b* comprises a roller 50*c* on its distal end which engages a pair of chains 52 and 54. Each chain 52, 54 is fixedly coupled at a first end 52*a*, 54*a* to the first mast 32*a* and coupled at a second end 52*b*, 54*b* to the platform assembly 130. Hence, movement of the piston 50*b* relative to the cylinder 50*a* effects movement of the platform assembly 130 relative to the base 31 via the roller 50*c* acting against the chains 52, 54 and the piston 50*b* acting against the second mast 32*b*. One unit of vertical movement of the piston 50*b* results in two units of vertical movement of the platform assembly 130. Hence, in the illustrated embodiment, the platform assembly 130 moves with the second mast 32*b* as the second mast 32*b* moves relative to the base 31 and further moves relative to the second mast 32*b*.

The load handling assembly 132 comprises a first structure 42 which is movable back and forth transversely relative to the platform assembly 130, as designated by an arrow 200 in FIG. 2, via a hydraulic motor (not shown). The load handling assembly 132 further comprises a second structure 44 (also referred to as an auxiliary mast) which moves transversely with the first structure 42 and is also capable of rotating relative to the first structure 42. In the illustrated embodiment, the second structure 44 is rotated back and forth relative to the first structure 42 through an angle of about 180° via first and second piston/cylinder units (not shown) provided in an upper portion 42*a* of the first structure 42. A similar arrangement for pivoting a second structure is disclosed in U.S. Pat. No. 5,011,363, the disclosure of which is incorporated herein by reference.

Coupled to the second structure 44 is the fork carriage assembly 136 comprising a pair of forks 62 and a fork support 64. The fork carriage assembly 136 is capable of moving vertically relative to the second structure 44, as designated by an arrow 201 in FIG. 1. While not shown in the figures, a piston/cylinder unit may be provided in each fork 62 for causing a corresponding sliding fork member (not shown), comprising part of the fork 62, to extend and retract relative to a corresponding fixed fork member (not shown), see again U.S. Pat. No. 5,011,363. Rotation of the second structure 44 relative to the first structure 42 permits an operator to position the forks 62 in one of at least a first position and a second position, wherein the second position may be located about 180° from the first position.

A second structure or auxiliary mast piston/cylinder unit 70 is provided in the second structure 44 for effecting vertical movement of the fork carriage assembly 136 relative to the second structure 44, see FIG. 1B. The cylinder 70*a* forming part of the piston/cylinder unit 70 is fixedly coupled to the second structure 44. The piston 70*b* forming part of the unit 70 comprises a roller 70*c* on its distal end which engages a chain 72. One unit of vertical movement of the piston 70*b* results in two units of vertical movement of the fork carriage assembly 136. The chain 72 is fixedly coupled at a first end 72*a* to the cylinder 70*a* and fixedly coupled at a second end 72*b* to the fork support 64. The chain 72 extends from the cylinder 70*a*, over the roller 70*c* and down to the fork support 64. Upward movement of the piston 70*b* effects upward movement of the fork carriage assembly 136 relative to the second structure 44, while downward movement of the piston 70*b* effects downward movement of the fork carriage assembly 136 relative to the second structure 44.

The hydraulic drive apparatus 80 supplies pressurized fluid to the mast piston/cylinder unit 50 and the second structure piston/cylinder unit 70. The hydraulic apparatus 80 may also provide pressurized fluid to the hydraulic motor for effecting transverse movement of the first structure 42, the first and second piston/cylinder units for effecting rotation of the second structure 44 and the first and second piston/cylinder units for causing the sliding fork members to extend and retract. The apparatus 80 comprises, in the illustrated embodiment, a hydraulic motor/pump assembly 82, a first manifold 90, and a hydraulic fluid reservoir 84, all of which are mounted on the main frame base 31, see FIGS. 1-3, 5 and 6. The hydraulic apparatus 80 further comprises a second manifold 190, shown in phantom only in FIG. 1, mounted in the upper portion 42*a* of the first structure 42, see FIG. 1. The motor/pump assembly 82 supplies hydraulic fluid from the reservoir 84 under pressure to the manifolds 90 and 190. In response to appropriate operator-generated commands, a hydraulic drive apparatus control module 400, see FIGS. 2 and 4, causes the first manifold 90 to provide pressurized fluid to the piston/cylinder unit 50 and further causes the first and second manifolds 90 and 190 to provide pressurized fluid to the piston/cylinder unit 70, the hydraulic motor for effecting transverse movement of the first structure 42, the first and second piston/cylinder units for effecting rotation of the second structure 44, and the first and second piston/cylinder units for causing the sliding fork members to extend and retract. Example first and second manifolds 90 and 190 are disclosed in patent application U.S. Ser. No. 10/948,723, entitled "ELECTRONICALLY CONTROLLED VALVE FOR A MATERIALS HANDLING VEHICLE," filed concurrently with this application, by Dammeyer et al., the disclosure of which is incorporated by reference herein.

As noted above, the power unit assembly 20 and the main frame assembly 30 are releasably coupled to one another. The power unit base 21 comprises a front plate member 210 provided with three openings in a first lower corner 210*a*, three openings in a second lower corner 210*b* and a pair of openings along an upper edge 210*c*, see FIG. 4. Bolts 300 extend through those openings such that head portions (not shown) of the bolts 300 engage a first side 210*d* of the front plate member 210 while threaded portions 300*a* of the bolts 300 extend through the openings in the plate member 210. A first horizontal member 310 and first and second vertical members 312 and 314, respectively, of the main frame base 31 are provided with openings 310*a*, 312*a*, and 314*b*, see FIGS. 5 and 6. The bolt threaded portions 300*a* extend through the openings 310*a*, 312*a* and 314*b* and nuts 315 are secured to the bolts 300 so as to releasably couple the power unit base 21 and the main frame base 31 to one another, see FIG. 3.

All hydraulic fluid lines extending from the reservoir 84 to the motor/pump assembly 82, from the motor/pump assembly 82 to the first and second manifolds 90 and 190 and from the first and second manifolds 90 and 190 to the mast piston/cylinder unit 50, the second structure piston/cylinder unit 70, the hydraulic motor for effecting transverse movement of the first structure 42, the first and second piston/cylinder units for effecting rotation of the second structure 44, and the first and second piston/cylinder units for causing the sliding fork members to extend and retract are contained within the main frame assembly 30. Hence, all vehicle hydraulic components including the hydraulic apparatus 80, the mast piston/cylinder unit 50 and the second structure piston/cylinder unit 70 are contained within the main frame assembly 30. This is advantageous as there is no need to disconnect any hydraulic tubes/lines extending between the power unit and main frame assemblies 20 and 30 when the vehicle 10 is to be separated. Hence, the vehicle disassembly operation is simplified. Further, risk of moisture, dirt, air, etc. contaminating open hydraulic tubes/lines is reduced. Also, the length of hydraulic tubes/lines required on the vehicle 10 is reduced since tubes/lines extending between the power unit and main frame assemblies 20 and 30 are not required. This reduces costs as well as pressure drops within the hydraulic apparatus 80.

The vehicle 10 comprises three substantial heat sources, which are: 1) the hydraulic fluid reservoir 84; 2) the motor/pump assembly 82 and the first manifold 90; and 3) the traction motor 23*a*, a gear box (not shown) coupled to and mounted below the motor 23*a* and the control modules 25, 27, 130 and 400. So as to allow the heat generated by those sources to be efficiently transferred from the vehicle 10, those elements are spaced apart from one another on the vehicle 10. In particular, the hydraulic fluid reservoir 84 is positioned to a first side 32*c* of the mast assembly 32 so as to be spaced from the motor/pump assembly 82 and the first manifold 90, which are positioned to a second side 38*d* of the mast assembly 38, see FIGS. 1 and 2. The control modules 25, 27, 130 and 400, the traction motor 23*a*, and the traction motor gear box (not shown) are mounted in a rear section 26 of the power unit assembly 20.

The power unit base 21 comprises first, second and third compartments 100, 110 and 120 located in the rear section 26 of the power unit assembly 20, see FIGS. 1 and 2. The traction motor 23*a* for driving the wheel 23 and a steer motor 24 for effecting steering movement of the wheel 23 are mounted in the second compartment 110, see FIG. 1. Mounted in the first compartment 100 is the traction motor control module 25 for controlling the operation of the traction motor 23*a*, i.e., its speed and direction of rotation, in response to operator generated commands. Also mounted in the first compartment 100 is a steer motor control module 27 for controlling the operation of the steer motor 24 in response to operator generated commands. Mounted in the third compartment 120 is the control module 400 for controlling the operation of the motor/pump assembly 82 and the first and second manifolds 90 and 190 in response to operator generated commands. Also mounted in the third compartment 120 is a guidance control module 130. The vehicle 10 may be provided with front and back sensors (not shown) for sensing a guide wire provided in the floor on which the vehicle 10 is operated. The control module 130 receives signals generated by those sensors and generates appropriate control commands to the steer motor control module 27 to ensure that the vehicle 10 is positioned correctly relative to the guide wire. The control module 130 may also include an end-of-aisle feature such that the vehicle 10 is slowed to a stop before leaving an aisle, i.e., a predefined area, in response to the control module 130 receiving signals from end-of-aisle sensors on the vehicle which sense end-of-aisle markers in or on the floor.

Each of the traction motor 23*a*, the steer motor 24 and the control modules 25, 27, 130 and 400 generate significant amounts of heat energy, which energy must be efficiently transferred from the vehicle. By placing the traction motor 23*a* and the steer motor 24 a spaced distance away from the control modules 25, 27, 130 and 400, efficient transfer of the heat generated by those elements from the vehicle 10 occurs. Furthermore, by locating the traction motor 23*a*, the steer motor 24 and the control modules 25, 27, 130 and 400 in the rear section 26 of the power unit assembly 20, those elements are spaced a substantial distance from the hydraulic fluid reservoir 84, the motor/pump assembly 82 and the first manifold 90, so as to improve thermal balance on the vehicle 10 and to facilitate dissipation of heat from those elements.

The power unit assembly 20 can be detached from the main frame assembly 30 by removing the nuts 315 from the bolts 300. Prior to separating the assemblies 20 and 30, power supply cables 405 extending from the power unit assembly 20 to the hydraulic motor/pump assembly 82 and wiring harnesses 410, three in the illustrated embodiment, extending from the power unit assembly 20 to the main frame assembly 30 need to be disconnected.

Having described the invention in detail and by reference to preferred embodiments thereof, it will be apparent that modifications and variations are possible without departing from the scope of the invention defined in the appended claims.

What is claimed is:

1. A lift truck comprising:

a power unit assembly comprising a power unit base, at least one wheel coupled to said base, and a system for driving said at least one wheel;

a main frame assembly detachably connected to said power unit assembly, said main frame assembly comprising a main frame base, a mast assembly coupled to said main frame base, a carriage assembly coupled to said mast assembly, and a hydraulic drive apparatus comprising a hydraulic motor/pump assembly receiving power from a battery of said power unit assembly, wherein substantially the entirety of said hydraulic drive apparatus including said hydraulic motor/pump assembly is provided on said main frame assembly such that said main frame assembly is detachable from said power unit assembly without requiring disconnecting hydraulic connections to said power unit assembly; and a control module controlling the operation of said hydraulic motor/pump assembly of said hydraulic drive apparatus, wherein said control module is mounted on said power unit base.

2. A lift truck as set forth in claim 1, wherein said hydraulic drive apparatus further comprises a hydraulic fluid reservoir, and a manifold system.

3. A lift truck as set forth in claim 2, wherein said main frame base comprises front and rear portions, said mast assembly, said hydraulic fluid reservoir and said hydraulic motor/pump assembly being located at said rear portion of said main frame base, and said reservoir being positioned on a first side of said mast assembly and said motor/pump assembly being positioned on a second side of said mast assembly.

4. A lift truck as set forth in claim 1, wherein said system for driving said at least one wheel comprises at least one traction motor, said battery providing power to said at least one traction motor, and a traction motor control module for controlling the operation of said at least one traction motor.

5. A lift truck as set forth in claim 4, wherein said main frame base comprises front and rear portions and said power unit base comprises front and rear portions, said rear portion of said main frame base being positioned adjacent to said front portion of said power unit base, and said at least one traction motor and said traction motor control module being located in said rear portion of said power unit base.

6. A lift truck as set forth in claim 5, wherein said power unit assembly further comprises a steer motor for effecting steering movement of said wheel and a steer motor control module for controlling the operation of said steer motor, said steer motor and said steer motor control module being located in said rear portion of said power unit base.

7. A lift truck as set forth in claim 1, wherein said mast assembly comprises a fixed first mast, a second mast movable relative to said first mast and a mast piston/cylinder unit for effecting movement of said second mast relative to said first mast.

8. A lift truck as set forth in claim 7, wherein said carriage assembly comprises a platform assembly coupled to said second mast so as to move with said second mast.

9. A lift truck as set forth in claim 8, wherein said platform assembly is capable of moving relative to said second mast.

10. A lift truck as set forth in claim 8, wherein said carriage assembly further comprises a load handler assembly movably coupled to said platform assembly and a fork carriage assembly movably coupled to said load handler assembly.

11. A lift truck comprising:

a power unit assembly comprising a power unit base having front and rear portions, at least one wheel, at least one traction motor for driving said at least one wheel, a battery for providing power to said at least one traction motor, and at least one traction motor control module for controlling the operation of said at least one traction motor, said at least one wheel, at least one traction motor and at least one traction motor control module being mounted in said rear portion of said power unit base;

a main frame assembly comprising a main frame base having front and rear portions, a mast assembly, a carriage assembly coupled to said mast assembly, and hydraulic drive apparatus coupled to said mast assembly, said front portion of said power unit base being coupled to said rear portion of said main frame base such that said main frame assembly is detachable from said power unit assembly without requiring disconnecting hydraulic connections to said power unit assembly, and said hydraulic drive apparatus comprising a hydraulic motor/pump assembly receiving power from said battery of said power unit assembly; and wherein said power unit assembly further comprises a hydraulic drive apparatus control module mounted in said rear portion of said power unit base for controlling the operation of said hydraulic drive apparatus.

12. A lift truck as set forth in claim 11, wherein said hydraulic drive apparatus further comprises a hydraulic fluid reservoir, and a manifold system.

13. A lift truck as set forth in claim 12, wherein said mast assembly, said hydraulic fluid reservoir and said hydraulic motor/pump assembly are located at said rear portion of said main frame base, said reservoir being positioned on a first side of said mast assembly and said motor/pump assembly being positioned on a second side of said mast assembly.

14. A lift truck as set forth in claim 11, wherein said power unit assembly further comprises a steer motor for effecting steering movement of said at least one wheel and a steer motor control module for controlling the operation of said steer motor, said steer motor and said steer motor control module being located in said rear of said power unit base.

15. A lift truck as set forth in claim 11, wherein said carriage assembly comprises a platform assembly which moves along said mast assembly.

16. A lift truck as set forth in claim 15, wherein said carriage assembly further comprises a load handler assembly movably coupled to said platform assembly and a fork carriage assembly movably coupled to said load handler assembly.

17. A lift truck comprising:

a power unit assembly comprising a power unit base, at least one wheel coupled to said base, and a system for driving said at least one wheel;

a main frame assembly detachably connected to said power unit assembly, said main frame assembly comprising a main frame base, a mast assembly coupled to said main frame base, a carriage assembly coupled to said mast assembly, and a hydraulic drive apparatus, wherein substantially the entirety of said hydraulic drive apparatus is provided on said main frame assembly such that said main frame assembly is detachable from said power unit assembly without requiring disconnecting hydraulic connections to said power unit assembly, said hydraulic drive apparatus comprising a hydraulic motor/pump assembly receiving power from a battery of said power unit assembly; and a control module controlling the operation of said hydraulic motor/pump assembly of said hydraulic drive apparatus, wherein said control module is mounted on said power unit base.

18. A lift truck as set forth in claim 17, wherein said hydraulic drive apparatus further comprises a hydraulic fluid reservoir, and a manifold system.

19. A lift truck as set forth in claim 18, wherein main frame base comprises front and rear portions, said mast assembly, said hydraulic fluid reservoir and said hydraulic motor/pump assembly being located at said rear portion of said main frame base, and said reservoir being positioned on a first side of said mast assembly and said motor/pump assembly being positioned on a second side of said mast assembly.

20. A lift truck as set forth in claim 17, wherein said system for driving said at least one wheel comprises at least one traction motor, said battery providing power to said at least one traction motor, and at least one control module for controlling the operation of said at least one traction motor.

21. A fork lift truck comprising a power unit assembly detachably connected to a main frame assembly, wherein substantially all truck hydraulic components including a hydraulic motor/pump assembly are mounted on the main frame assembly while all truck electronic control modules including a module for controlling said hydraulic motor/pump assembly are mounted on the power unit assembly, and wherein said hydraulic motor/pump assembly receives power from a battery of said power unit assembly, and said main frame assembly is detachable from said power unit assembly without requiring disconnecting hydraulic connections to said power unit assembly.

* * * * *